United States Patent [19]

Zuber et al.

[11] Patent Number: 4,625,279

[45] Date of Patent: Nov. 25, 1986

[54] VEHICLE SPEED CONTROL APPARATUS AND METHOD

[75] Inventors: Pierre A. Zuber, Baldwin; Norman W. May, Pittsburgh; Robert J. DiSilvestro, Monroeville; Richard S. Rhoton, Pittsburgh, all of Pa.

[73] Assignee: Westinghouse Electric Corp., Pittsburgh, Pa.

[21] Appl. No.: 609,253

[22] Filed: May 11, 1984

[51] Int. Cl.[4] ..... B61L 3/20; H04Q 9/00

[52] U.S. Cl. ..... 364/426; 364/517; 246/187 R; 246/182 R; 340/47; 307/231

[58] Field of Search ..... 364/426, 517, 484, 565; 375/91, 96, 97, 99; 246/187 R, 167 R; 371/68; 340/47, 825.58, 825.6; 307/518, 520, 525, 231

[56] References Cited

U.S. PATENT DOCUMENTS

| | | | |
|---|---|---|---|
| 3,749,994 | 7/1973 | Matty | 318/563 |
| 3,783,339 | 1/1974 | Matty | 317/5 |
| 3,974,992 | 8/1976 | Matty | 246/182 B |
| 3,992,698 | 11/1976 | Sahasrabudhe et al. | 246/187 B |
| 4,015,082 | 3/1977 | Matty et al. | 178/66 |
| 4,209,828 | 6/1980 | Anderson et al. | 364/426 |
| 4,333,150 | 6/1982 | Matty | 375/91 X |
| 4,488,238 | 12/1984 | Salmon et al. | 364/483 |

*Primary Examiner*—Felix D. Gruber
*Assistant Examiner*—Thomas G. Black
*Attorney, Agent, or Firm*—E. F. Possessky

[57] ABSTRACT

A passenger vehicle speed control apparatus and method are operative with a track providing an input speed command having ONEs and ZEROs information components. At least two programmed microprocessors operate with the vehicle and redundantly decode the ONEs and ZEROs input speed command signal components through operation of a fixed frequency filter for each of a plurality of frequency pairs and a variable frequency filter tuned to the frequency of the fixed filter having the highest amplitude signal component for determining a speed command signal to control the movement speed of the vehicle.

10 Claims, 12 Drawing Figures

300
TEST CARRIER
542
9 HZ
543
304
549
574
CLIPPER/
DRIVER
576
TRACK
SIGNAL
A
564
566
568
548
TRACK
SIGNAL
A/B
K2
570
572
546
PREAMP
A/B
SELECT
582
KI
CLIPPER/
DRIVER
580
544
KEYSWITCH
TRACK
SIGNAL B
302
TEST CARRIER
9 HZ

VEHICLE SPEED CONTROL APPARATUS AND METHOD

CROSS-REFERENCE TO RELATED APPLICATIONS

The present application is related to a previously filed patent application Ser. No. 496,693 now U.S. Pat. No. 4,558,415 which was filed May 5, 1983 by P. A. Zuber et al. and entitled "Vehicle Speed Control Apparatus and Method", and is assigned to the same assignee as the present application; the disclosure of which is incorporated herein by reference.

BACKGROUND OF THE INVENTION

The present invention relates to the speed control of passenger vehicles, such as mass transit vehicles or the like, and including the decoding of wayside-provided speed codes for which vehicle speed control and speed maintenance purposes while the vehicle is moving along a roadway track.

It is known in the prior art to provide a checked redundancy speed error determination as disclosed in U.S. Pat. No. 3,749,994 of T. C. Matty. It is also known in the prior art to individually decode the ones data and the zeros data of an input speed command from the roadway track, and then to compare the ones data with the zeros data to detect any discrepancy as disclosed in U.S. Pat. No. 4,015,082 of T. C. Matty et al.

Mechanical and crystal filters have been used in past passenger vehicle speed control apparatus to receive the speed codes transmitted from the wayside to the vehicle via the running rails. The signal modulating scheme consists of a pair of discrete frequencies in the five to ten kilohertz range modulated by frequency-shift-keying and phase-shift-keying into a six-bit comma-free code.

Typically, four pairs of different frequencies are used to accommodate different blocks of tracks. A block is a section of track with individual detection and speed code transmission capability associated with it. The reception of these speed codes requires filters with narrow bandwidths, sharp cutoffs, and high stability. Mechanical and crystal filters have these characteristics and are intrinsically failsafe since they possess no failure mode which of itself would cause the overall gain or bandwidth to increase.

When coupled with a failsafe threshold detection circuit, mechanical and crystal filters provide a vital signal reception scheme with acceptable performance. They have been used in train control systems on board steel wheel and rubber tire vehicles in many mass transit systems.

A general description of the microprocessors and the related peripheral devices as shown in FIG. 4 of the drawings is provided in the Intel Component Data Catalog currently available from Intel Corporation, Santa Clara, Calif., 95051.

SUMMARY OF THE INVENTION

An improved passenger vehicle speed control apparatus and method are provided for a vehicle operative with a track providing an input speed command including ONEs and ZEROs information components. At least two independent programmed microprocessor channels respectively perform the speed command decoding operation in relation to the ONEs and ZEROs information components of the input speed command, using fixed frequency solid-state filters each tuned to one frequency of the provided four frequency pairs of speed command information. An additional hunter or variable frequency solid-state filter is sent to the complementary frequency of the highest amplitude frequency pair determined.

DESCRIPTION OF A PREFERRED EMBODIMENT

It is known to control a passenger vehicle moving along a roadway track with binary coded speed command signals received from the track, and which signals include binary logic ONEs and ZEROs information represented by multiple message frequencies. This information is decoded such that extraneous noise signals will not cause the vehicle to operate in an unsafe manner, such as disclosed in U.S. Pat. No. 4,015,082 of T. C. Matty et al.

It is known in rapid transit control systems to encode and transmit the speed code information to the vehicle by modulating one or more carrier frequencies, such as by providing one of the four frequency pairs listed in the following TABLE ONE to carry the speed command to the vehicle.

TABLE ONE

| Frequency Pair | Logical level "1" | Logical level "0" |
|---|---|---|
| A | 5184 Hz | 7776 Hz |
| F | 5600 Hz | 8400 Hz |
| B | 5842 Hz | 8764 Hz |
| C | 6624 Hz | 9936 Hz |

The speed command can be encoded into a multiple bit comma-free code which is then transmitted to the vehicle using frequency shift key/phase shift key modulation with an 18 Hz data rate. In each frequency pair, the lower frequency can correspond to the logical level "1" while the higher frequency can correspond to the logical level "0". On board the vehicle, filters are required to filter out these carriers in order to recover the speed code information. It is known to provide the desired safety of the system through the integrity of reception, using crystal or mechanial filters, which filters exhibit a failsafe gain in addition to their high selectivity and stability.

Figure 1:
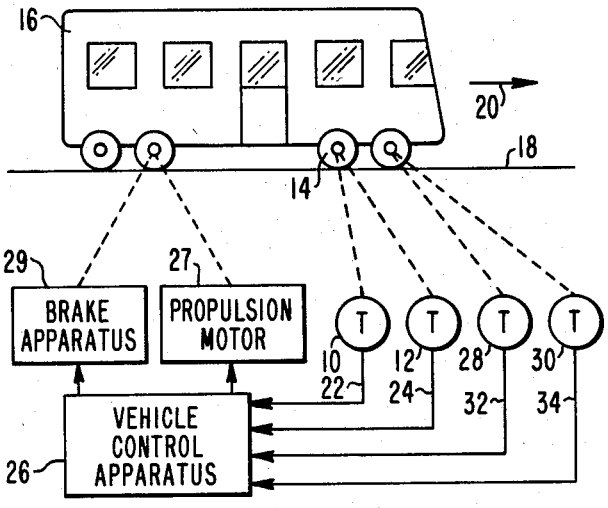
FIG. 1 PRIOR ART
FIG. 1 shows a prior art vehicle control apparatus for a passenger vehicle.

In FIG. 1 there is shown passenger vehicle control apparatus such as disclosed in U.S. Pat. No. 3,783,339, and including first and second tachometers 10 and 12 coupled with a first axle 14 of a vehicle 16 operative with a roadway track 18. The tachometers 10 and 12 are aligned relative to one another in a predetermined relationship such that if the vehicle is traveling in a forward direction as indicated by arrow 20, an output 22 signal is provided from the tachometer 10 which is displaced in a first phase relationship with the output signal 24 from the tachometer 12. In the event the vehicle is traveling in a reverse direction, the output signals appearing at the leads 22 and 24 are displaced from one another in a different and second phase relationship. In this way, the vehicle control apparatus 26 can provide a desired operation of the propulsion motor 27 or the brake apparatus 29 in response to the determined movement direction of the vehicle 16 by the relative phase displacement relationship of the signals 22 and 24. Similarly, the tachometers 28 and 30 provide output signals 32 and 34 which have a first phase relationship when the vehicle is moving forward in the direction of the arrow 20 and a second and different phase relationship when the vehicle 16 is moving in the reverse direction.

Figure 2:
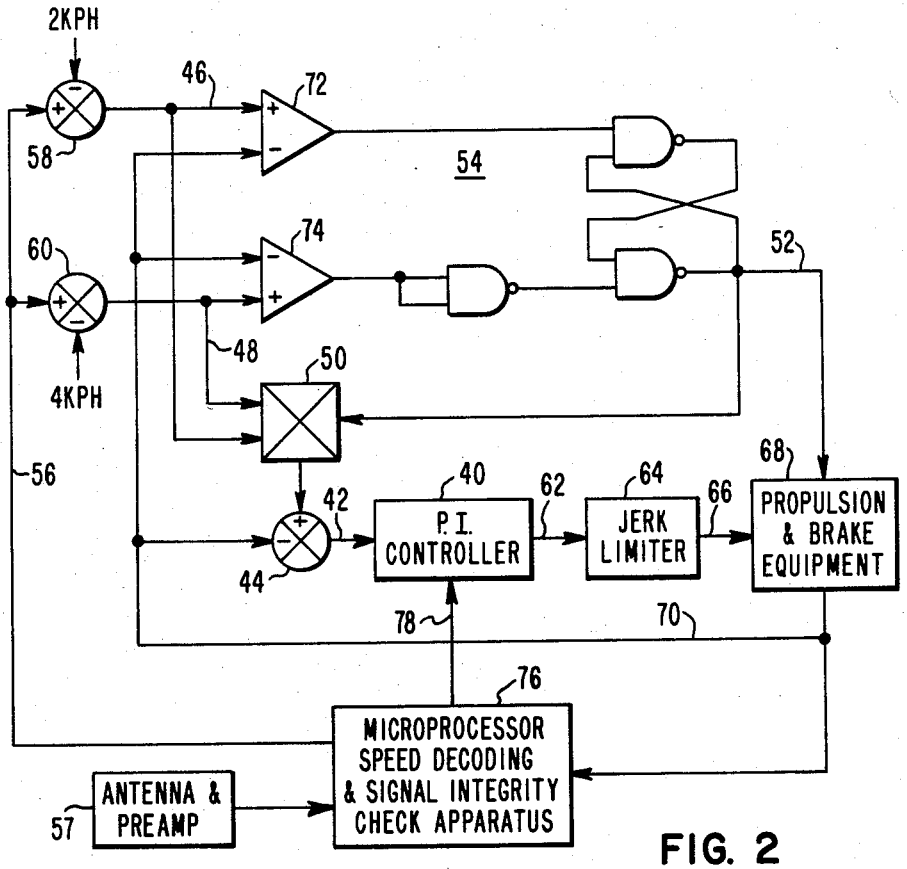
FIG. 2 PRIOR ART
FIG. 2 shows a prior art speed decoding apparatus operative to enable the effort request signal generator in a vehicle speed maintaining control apparatus.

In FIG. 2 there is provided a functional schematic of a prior art speed decoding and signal integrity check apparatus operative to enable the effort request signal generator in a vehicle speed maintaining control apparatus, such as disclosed in U.S. Pat. No. 4,217,643 of L. W. Anderson et al. A proportional plus integral controller 40 responds to a speed error signal 42 from a comparator 44 responsive to a speed feedback signal 70 and one of a brake reference velocity signal 46 or a power reference velocity 48, through operation of a selector 50 that responds to the brake mode or the power mode output control signal 52 of a power and brake controller 54. A decoded input speed command signal 56 is supplied to a first comparator 58 to provide the brake reference velocity signal 46 so that is 2 KPH below the value of the speed command signal 56, and is operative with a comparator 60 to provide the power reference velocity signal 48 that is 4 KPH below the speed command signal 56.

The PI controller 40 provides an output first effort request P signal 62 to a jerk limiter 64, which provides an output second effort request P signal 66 to the propulsion and brake equipment 68 of a transit vehicle. The output signal 52 from the power and brake controller 54 is either a brake mode control signal having a zero value or a power mode control signal having a one value. The actual speed 70 of the vehicle is fed back as an input to the power and brake controller 54. When the actual speed 70 is above the brake reference velocity signal 46, the comparator 72 causes the power and brake controller 54 to provide the brake mode control signal 52 to the propulsion and brake equipment 68. When the actual speed signal 70 is less than the power reference velocity signal 48, the comparator 74 causes the power and brake controller 54 to provide the power mode control signal 52 to the propulsion and brake equipment 68.

The programmed multiprocessor speed decoding and signal integrity check apparatus 76 is in accordance with the disclosure of U.S. Pat. No. 4,209,828 of L. W. Anderson et al., the disclosure of which is incorporated herein by refernce, and which compares the decoded input speed command signal 56 from the track signal antenna and preamp 57 with the vehicle actual speed signal 70 to provide an enable signal 78 to the PI controller 40 to enable the provision of the effort request signal 62 when the zeros data speed error signal, determined in accordance with the zeros data of the input speed command 56, is substantially the same as the ones data speed error signal.

Figure 3:
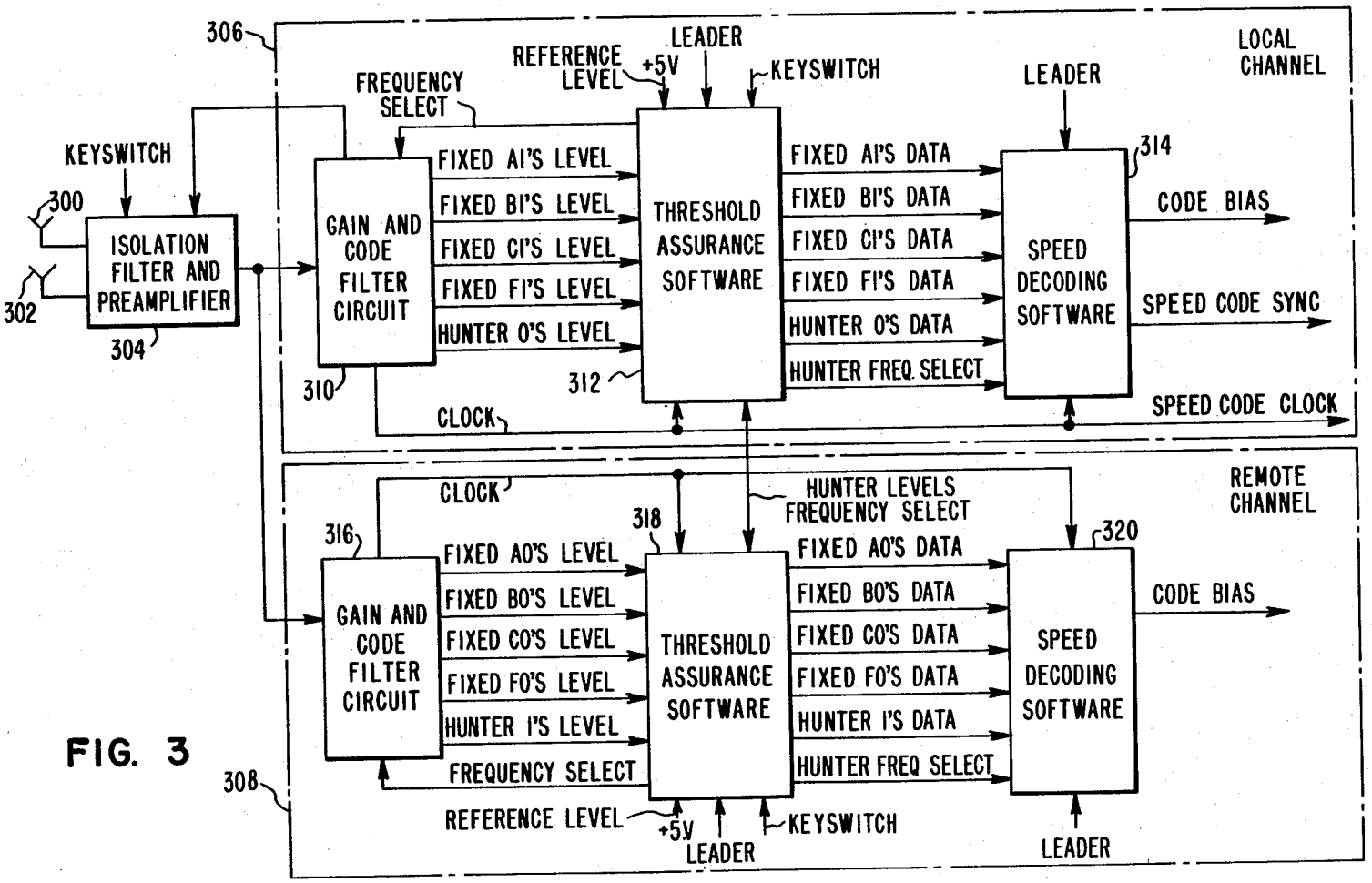
FIG. 3 shows a functional block diagram of the speed decoding apparatus of the present invention.

In FIG. 3, there is shown a functional block diagram of the threshold determination and speed decoding apparatus and method of the present invention. The track signal antennas 300 and 302 provide the speed coded signals to an isolation filter and preamplifier 304. The speed coded signals then branch and go to each of a local threshold assurance and speed dividing channel 306 and a remote threshold assurance and speed decoding channel 308. The local channel 306 includes a gain and code filter hardware circuit 310, a threshold assurance software 312 and a speed signal decoding software 314. The remote channel 308 includes a gain and code filter hardware circuit 316, a threshold assurance software 318 and a speed signal decoding software 320. The local channel gain and code filter circuit 310 includes a plurality of solid state commutation filters, which per se are well known to persons skilled in this art, as described. If an input signal at the commutating frequency of the filter, which frequency is selected to be either the ONEs or the ZEROs frequency of one of the known frequency pairs of the speed coded signals to be detected, is applied to the filter, the same average voltage appears across the respective individual capacitors each time the capacitors are switched to receive the input signal. In effect, each capacitor sees the same signal magnitude and quickly charges to a corresponding average value. As the individual capacitor segments are sequenced by the commutator, a step format reproduction of the input signal is derived. If the input signal differs either higher or lower than the commutating frequency of the particular filter, each individual capacitor of that filter will see random portions of the input signal during each sample period to result in each capacitor assuming a lower average voltage. The input signal frequency response is determined by the selected commutating frequencies. The gain and code filter circuit 310 for the local channel 306 is provided with respective fixed frequency filters tuned to respond to each ONEs frequency of the A, B, C and F frequency pairs, and is provided with a variable frequency filter tuned to respond to the complementary ZEROs frequency of the received frequency pair determined to have the highest amplitude. The gain and code filter circuit 316 for the remote channel 308 is provided with respective fixed frequency filters tuned to respond to each ZEROs frequency of the A, B, C and F frequency pairs, and is provided with a variable frequency filter tuned to respond to the complementary ONEs frequency of the received frequency pair determined to have the highest amplitude.

The threshold assurance software 312 of the local channel 306 is operative to establish which of the received ONEs signals of the provided A, B, C and F signal frequency pairs is above a predetermined reference level for determination of valid speed code signal data. The threshold assurance software 318 of the remote channel 308 is operative to establish which of the received ZEROs signals of the provided A, B, C and F frequency pairs is above that reference level for determination of valid speed code signal data.

The speed decoding software 314 of the local channel 306 processes the received ONEs data from a fixed filter and the received ZEROs data from the variable filter to determine a valid speed command code bias. This code bias is operative with a lock-up table to determine the desired input speed command.

Separate storage is provided for at least the last twelve bits from each of the five filters. The variable or hunter filter and the corresponding fixed filter are checked for valid codes. A sequence of data bits is accepted as a valid code if the last twelve bits received from the fixed filter formed two idential and consecutive 6-bit valid speed code sequences and the last six bits received from the hunter filter formed the same 6-bit valid speed code sequence. The code bias shall reflect the valid code, in any rotation.

The speed decoding software 320 of the remote channel 308 is similarly operative to process the received ZEROs data from a fixed filter and the received ONEs data from the hunter filter to determine the valid speed command code bias, which is used to determine the desired input speed command.

Figure 4:
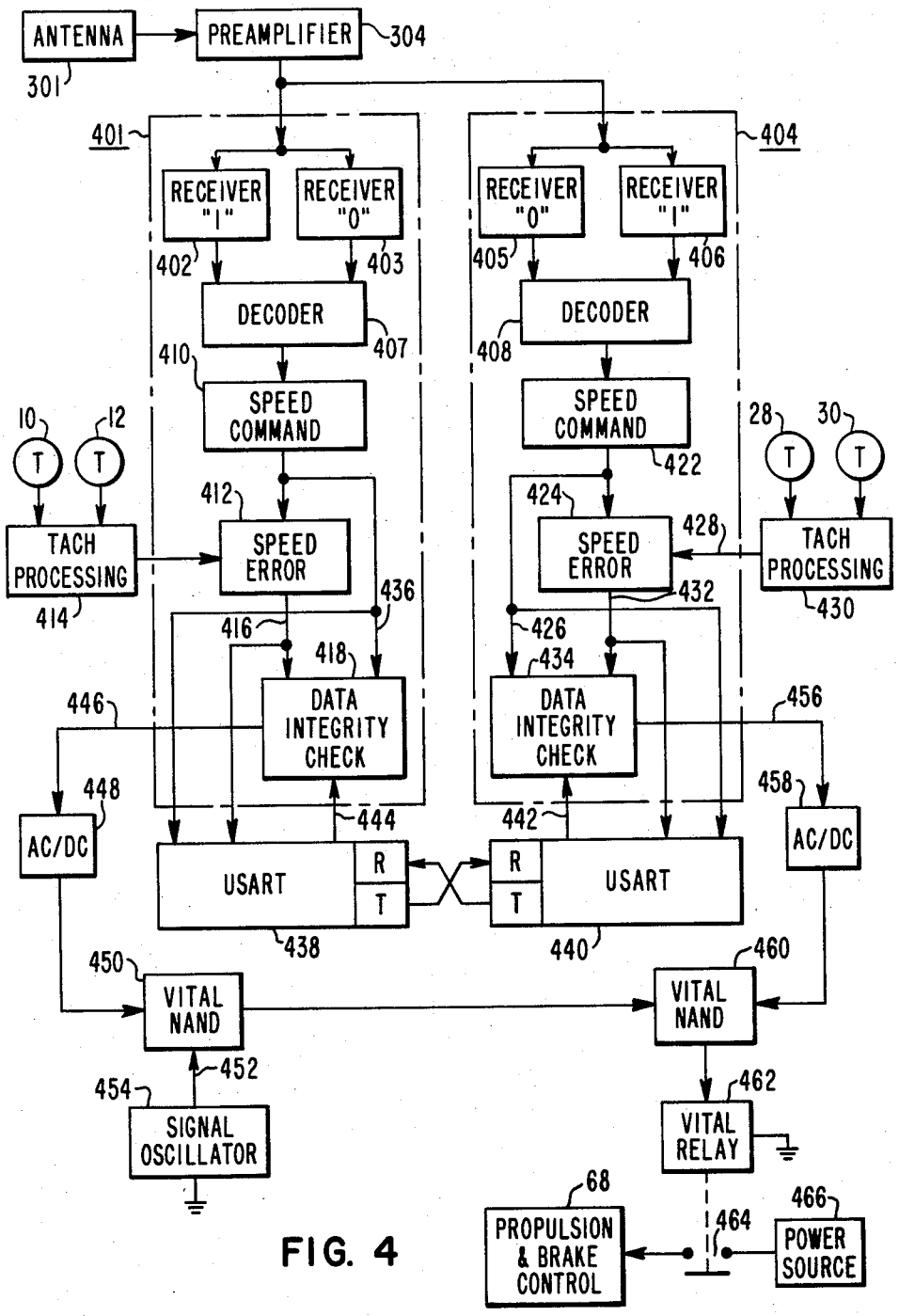
FIG. 4 shows a schematic block diagram to illustrate the sequential operations of the speed control apparatus of the present invention.

In FIG. 4 there is shown a functional block diagram to illustrate the sequential operations of the speed control apparatus of the present invention. The vehicle-carried antenna senses the input speed command signal from the roadway track, and the signal strength is increased in a preamplifier. The signal then passes to a first microprocessor channel 401 including a receiver 402 tuned to the ones data component of the input speed command signal, and a receiver 403 tuned to the ZEROs data component of the input speed command signal. A second microprocessor channel 404 includes a receiver 405 tuned to the ZEROs data component and a reciver 406 tuned to the ONEs data component of the input speed command signal. A decoder 407 within the first microprocessor channel 401 operates to provide the speed command bias in relation to the ONEs data from the receiver 402 and the ZEROs data from the receiver 403. At block 410 the speed command for the first microprocessor channel 401 is determined. A speed error determination apparatus 412 compares the speed command 436 with the vehicle speed from the tachometers 10 and 12 which pass through a well-known tachometer processing apparatus 414, to provide the vehicle speed error 416. The speed error 416 is supplied to a data integrity check apparatus 418 for the microprocessor channel 401.

The ZEROs data signal from the receiver 405 and the ONEs data signal from the receiver 406 operate with the decoder 408 to provide the speed command bias for the second microprocessor channel 404 from the decoder 422. A speed error determining apparatus 424 compares the speed command 426 with the vehicle speed 428 from a tachometer processing apparatus 430 operative with the tachometers 28 and 30 such as shown in FIG. 1. The speed error signal 432 is supplied to a data integrity check apparatus 434 for the data microprocessor channel 405.

The speed command signal 436 for the first microprocessor channel 401 and the speed error 416 are supplied to a well-known USART apparatus 438 operative with the microprocessor channel 401 to transmit each of the speed command 436 and the speed error 416 to a similar USART communication interface 440 operative with the microprocessor channel 404. The speed error 416 and speed command signal 436 are supplied through output 442 to the data integrity check apparatus 434 of the microprocessor channel 404. Similarly, the speed commnd 426 and the speed error 432 are transmitted by the USART 440 to the USART 438 and are provided through output 444 to the data integrity check apparatus 418 for the microprocessor channel 401. The programmable communication interface serial link apparatus 438 and 440 can include an Intel 8251A programmable data communication apparatus and related equipment, such as is described in the Intel Component Data Catalog from the Intel Corporation, Santa Clara, Calif., 95051. It takes a finite time for this serial transmission to occur, so a balance timer delay of about 250 milliseconds is provided for the operation of the data integrity checks 418 and 434.

After the balance time delay, if the speed command 436 and the speed command 426 in data integrity check 418 compare and are substantially the same, and if the speed error 416 and the speed error 432 in the data integrity check apparatus 418 compare within a predetermined difference such as 5 KPH, then an output toggle signal 446 having a predetermined frequency, such as 9 hertz, is supplied through an AC to DC converter 448 to enable a vital NAND circuit 450 to pass a predetermined control signal 452 from a signal generator 454. This control signal 452 can have a predetermined frequency such as 159 kilo hertz modulated by 109 hertz. Similarly, after the balance time delay, if the speed command 426 compares and is substantially the same as the speed command 436 in the data integrity check 434 and if the speed error 432 compares within a predetermined difference such as 5 KPH with the speed error 416 in the data integrity check 434, then an output toggle signal 456 having a predetermined frequency such as 9 hertz, is provided through an AC to DC converter 458 to enable a vital NAND circuit 460 to pass the signal from the vital NAND circuit 450. If each of the vital NANDS 450 and 460 are enabled in this manner to pass the signal 452, this will energize the vital relay 462 including a relay driver to close a contact 464 for energizing the propulsion and brake control 68 from the power source 466.

Figure 5A:
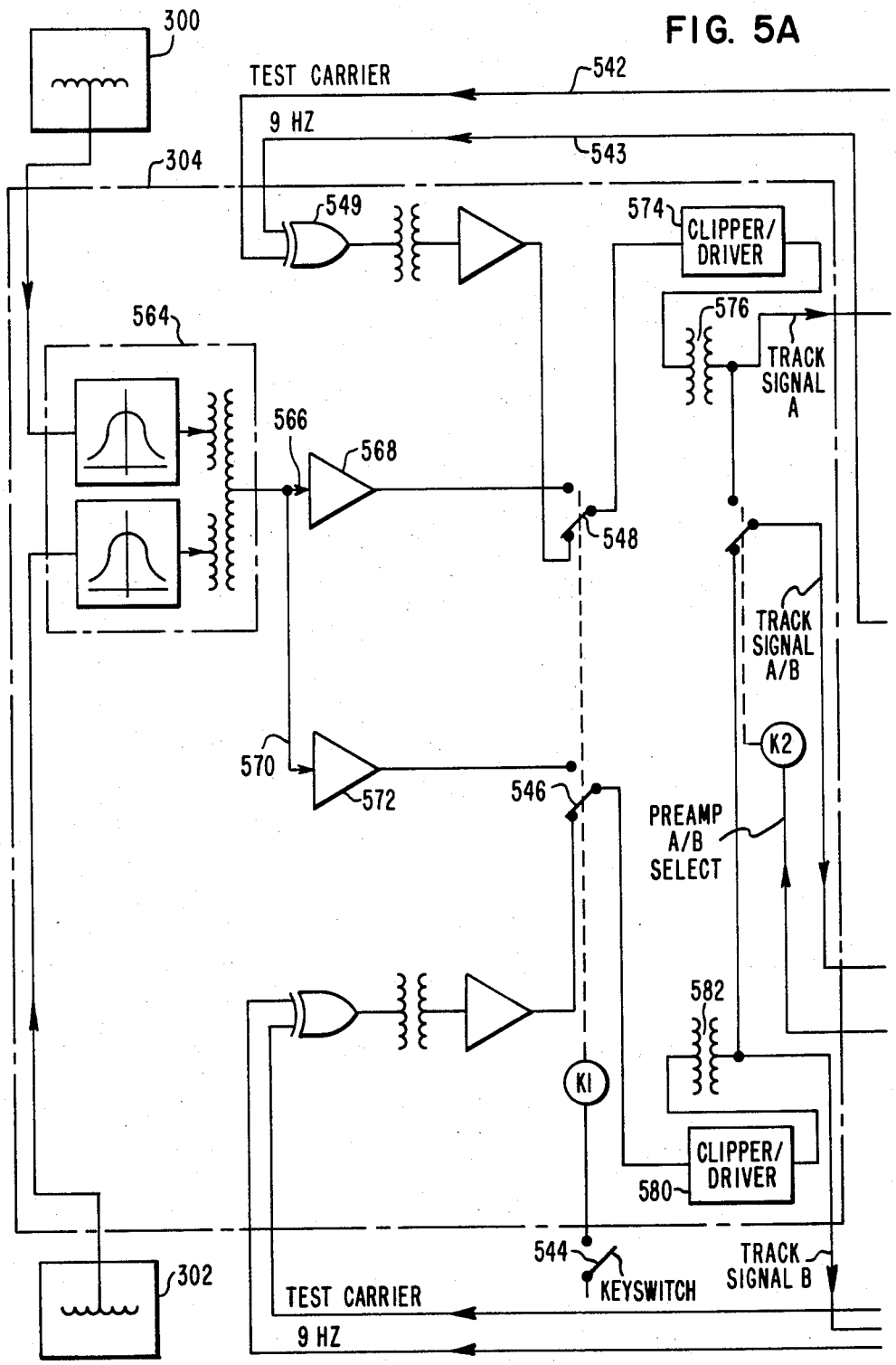
FIGS. 5A and 5B shows a hardware block diagram of the speed command signal receiving and decoding apparatus of the present invention.
Figure 5B:
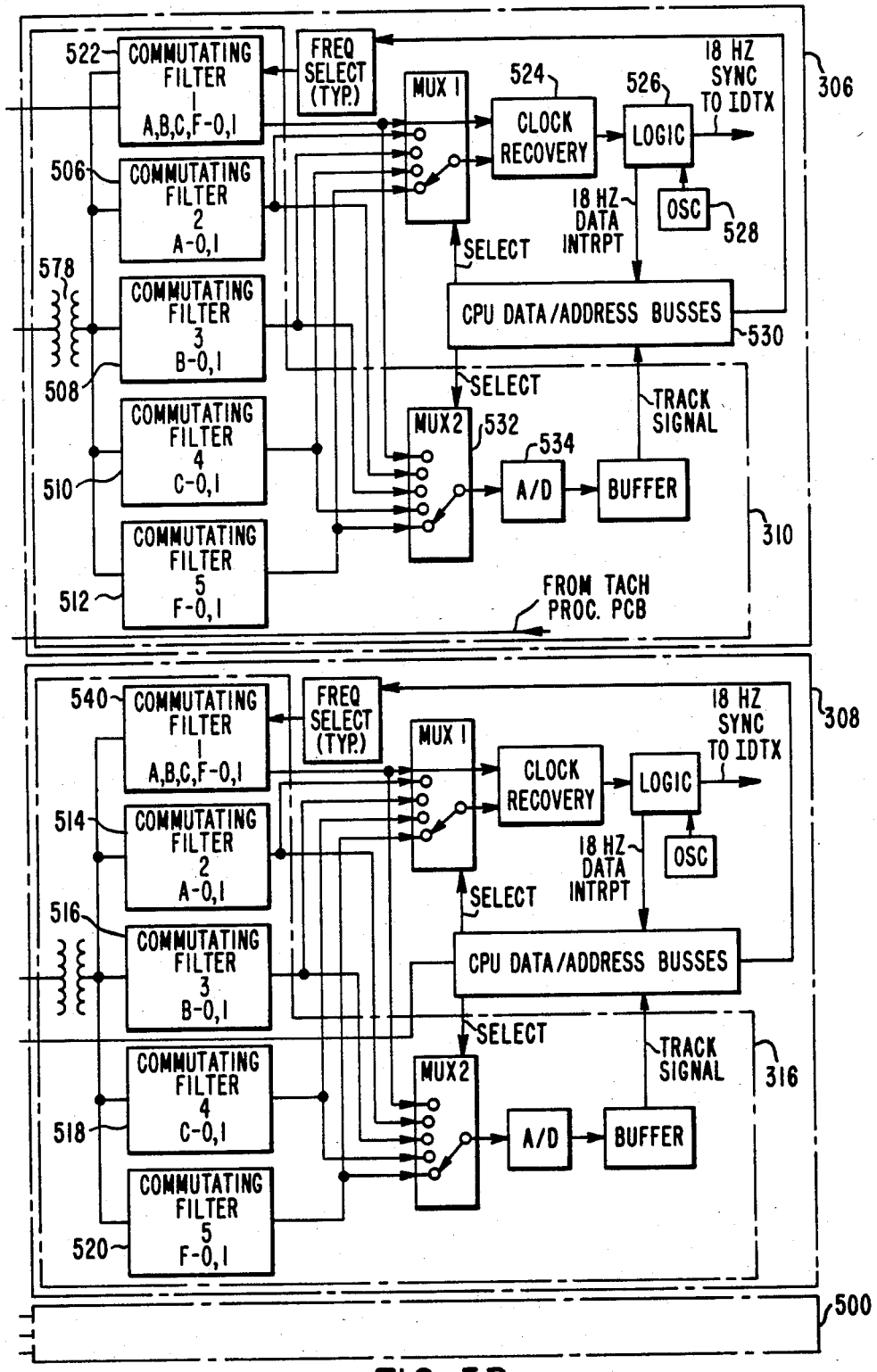

In FIGS. 5A and 5B there is shown from FIG. 3, the track signal antennas 300 and 302, the isolation transformer and filter and preamplifier 304, the hardware gain and code filter circuit 310 of the local microprocessor channel 306, and the hardware gain and code filter circuit 316 of the local microprocessor channel 308. A third microprocessor channel 500 is provided as a second local channel in the event that the first local channel 306 should become not satisfactorily operative. The channel 306 can operate as the local channel and the remote channel can be either of the channels 308 and 500, or the channel 500 can operate as the local channel and the remote channel can be either of the channels 306 and 308. Each of the decoder microprocessor channels 306, 308 and 500 includes four fixed frequency filters that are tuned to either the ones or zeros of the respective frequency pairs. For example, if the channel 306 is the local channel, the filter 506 can be tuned to the ONES frequency of the A frequency pair, the filter 508 can be tuned to the ONES frequency of the B frequency pair, the filter 510 can be tuned to the ONES frequency of the C frequency pair and the filter 512 can be tuned to the ONES frequency of the F frequency pair. If the channel 308 is the remote channel, the filter 514 can be tuned to the ZEROS frequency of the A pair, the filter 516 can be tuned to the ZEROS frequency of the B pair, the filter 518 can be tuned to the ZEROS frequency of the C pair and the filter 520 can be tuned to the ZEROS frequency of the F pair. Thusly, all filters are tuned to the ZEROS frequencies in the receiver channel 308 and to the ONES frequencies in the other receiver channel 306. In addition, a fifth filter is added to each of the receiver channels 306, 308 and 500, which fifth filter is identical in design to the other four filters in each channel, and is under control of a microprocessor to be set to any of the eight frequencies and is tuned to the complementary frequency of the fixed filter in the same channel that is receiving the greatest signal strength. For example, if the four fixed filers 506, 508, 512 and 512 of local channel 306 are tuned to the ONES frequencies, then the fifth filter 522 will lock into the ZEROS frequency of the pair A, B, C or F whose ONES frequency is detected as having the highest amplitude. Since the local and remote channel receivers have between them a fixed filter examining each of the eight frequencies, the decoder can immediately determine the frequency transmission of the next speed code bit. The speed code bits are transmitted at an 18 Hz rate, with bit separation provided by means of the phase modulation such that every 1/18th of a second, the phase of the speed code signal is shifted by 180°. This phase shift is recovered by the clock recovery 524, logic 526 and oscillator 528 to synchronize a local 18 Hz oscillator which generates an interrupt signal to the control microprocessor 530. When this interrupt occurs, the analog signal issued from each filter is sampled by the multiplexer 532, converted into a digital format by the A to D converter 534 and read by the computer 530. The level of each filter signal is then compared to a predetermined threshold which when exceeded indicates that a valid speed code signal bit is being received. The signal issued from the fifth filter 522 is read and compared to the signal received by the corresponding frequency pair fixed filter. The information from the four fixed filters 506, 508, 510, 512 is then used to tune the fifth filter 522 to the complementary frequency of the strongest valid signal. The speed command which results from the local channel 306 is compared with the speed command issued by the redundant remote channel receiver 308, and if both of these speed command signals agree, then speed control of the vehicle is permitted.

In the second remote channel receiver 308, the four fixed filters 514, 516, 518 and 520 as well as the fifth filler 540 are set in the opposite configuration of the first receiver 306. For example, if in the first receiver 306 the fixed filters 506, 508, 510 and 512 are tuned to the ONES frequency, then in the second receiver 308, the fixed filters 514, 516, 518 and 520 will be set to the ZEROS frequencies and the fifth filter 540 to the ONES frequency.

In order to improve system reliability and to reduce the probability of an unsafe failure, a test signal 542 of a known frequency and level can be adjusted into the speed code receiver 306 every time the receiver 306 is not required to process data from the wayside for the control of vehicle speed, such as when the vehicle including the receivers 306, 308 and 500 is not head end. This is established by the operator key switch 544, which the operator closes when the vehicle including the decoder receivers 306, 320 and 500 is a head end control car in a train of such cars, to position the relay contacts 546 and 548 in the upper position opposite to that shown in FIG. 5. The left track signal antenna 300 and the right track signal antenna 302 provide sensed speed coded command signals through the band-pass filters and the isolation transformer box 564. The sensed track speed command signal, including one particular frequency pair, passes to the preamplifier 568. With the key switch 544 closed for a head end car having an operator, the local channel contact 548 will be up and the track signal will go through the clipper driver 574 and transformers 576 and 578 to the local receiver channel 306. The switch 550 will be up and the track signal will also go through the transformer 580 to the remote receiver channel 308.

The threshold assurance software 312 and the speed decoding software 314 of the local channel 306 are stored in the microprocessor 530. The threshold assurance software 318 and the speed decoding software 320 of the remote channel 308 are stored in the microprocessor 590.

If it is desired that the channel 500 operate as the local channel with the remote channel 308, the switch 550 is positioned as shown in FIG. 5A. Each of the channels 306, 308 and 500 includes a gain and code filter circuit, the threshold software and the speed decoding software as shown in FIG. 3, and the desired operative channels are selected by energization of the microprocessor for each such channel.

Figure 6A:
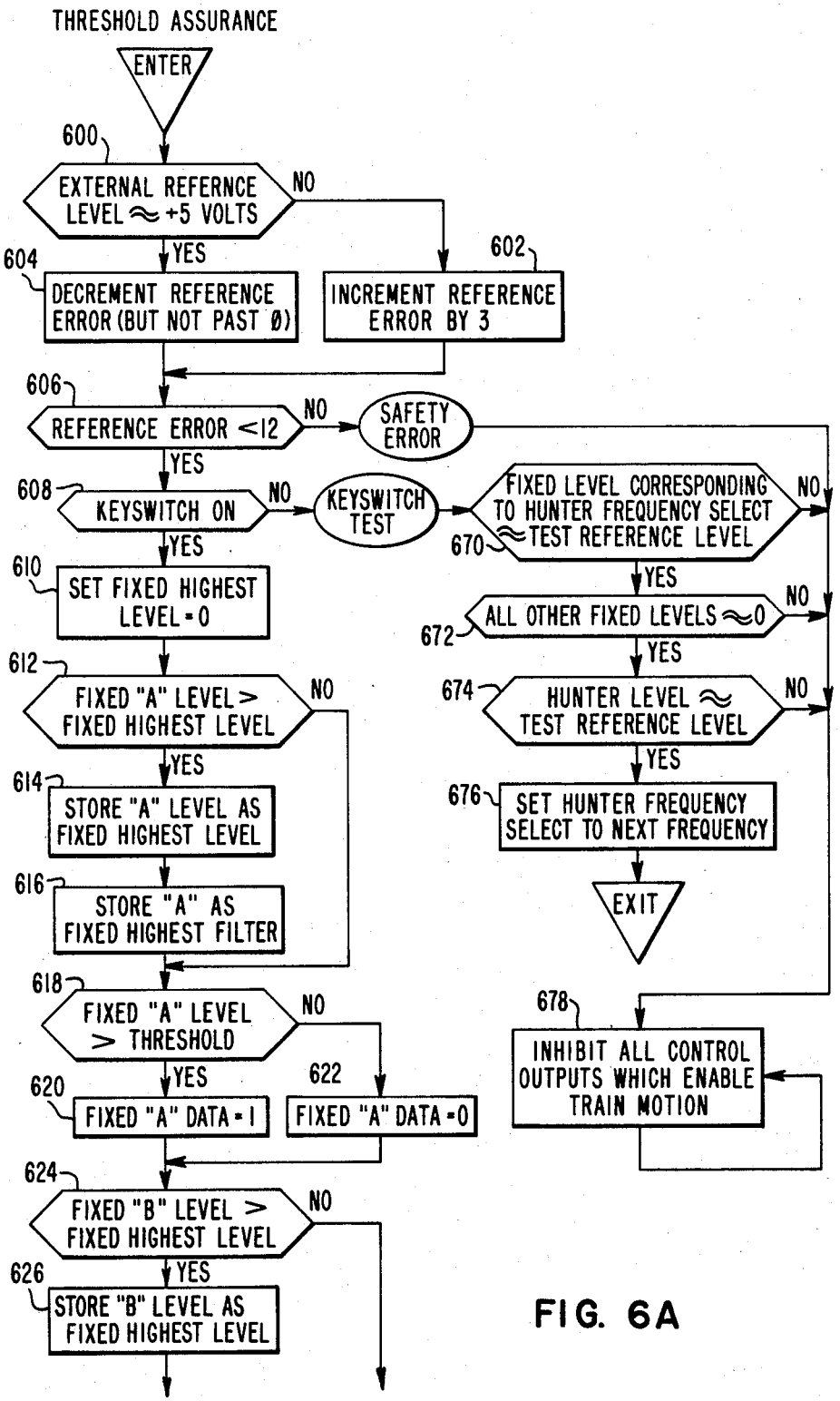
FIGS. 6A and 6B shows a flow chart to illustrate the threshold assurance software operation of the present invention.
Figure 6B:
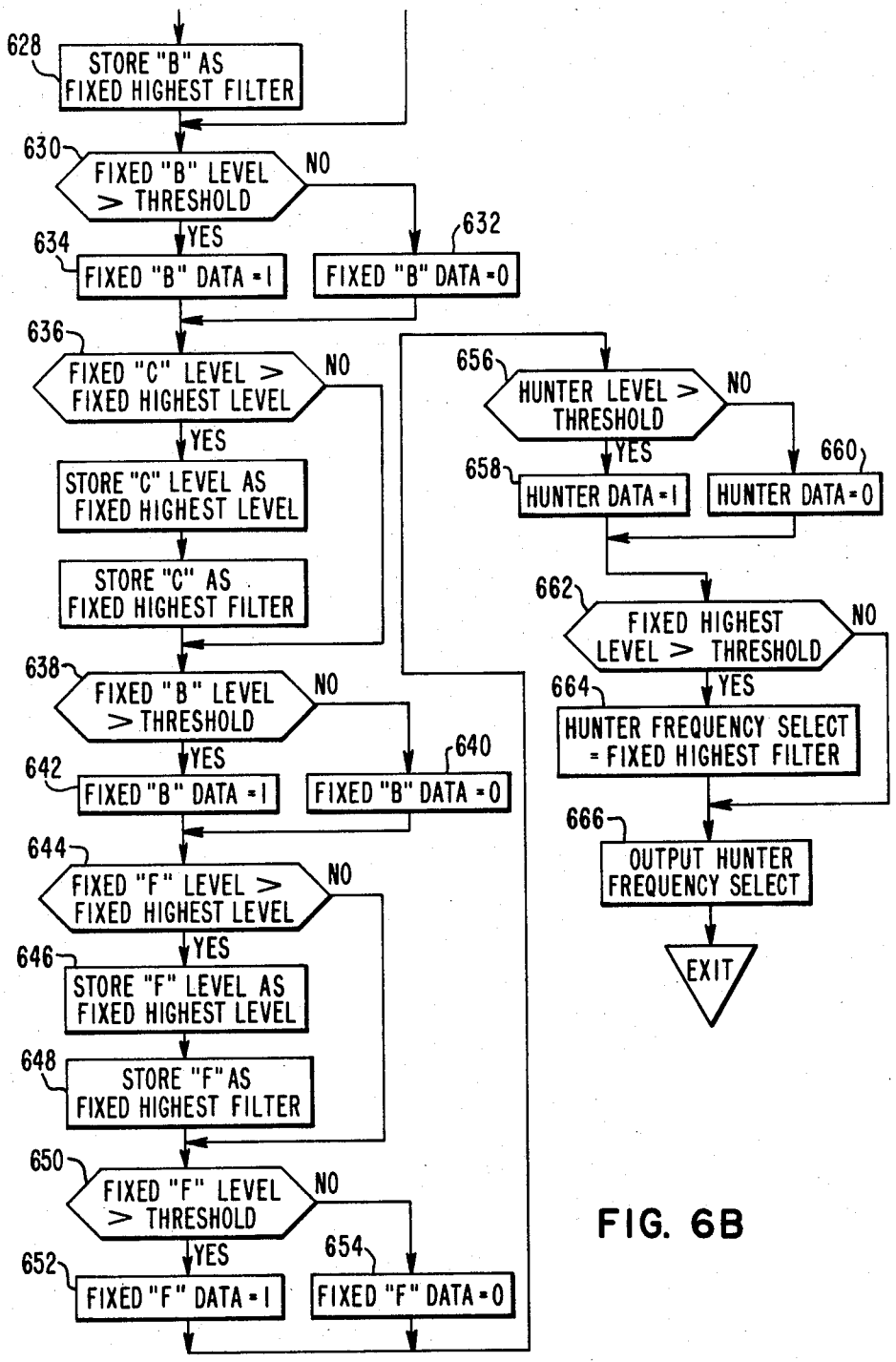

In FIGS. 6A and 6B there is shown a flow chart to illustrate the operation of the threshold assurance software shown in FIG. 3 for each microprocessor channel. It is assumed that the input signal data has been read and is stored in memory. At block 600 a check is made to see if the external reference level is approximately equal to plus 5 volts, to determine that the A to D converter is working properly since it is common to succeeding speed control operations. If not, at block 602 the reference error variable is incremented by three. If yes, at block 604 the reference error variable is decremented, but not pass zero. At block 606 a check is made to see if the reference error is less than 12, and if not, which would indicate excessive errors, a safety error condition is indicated. The 3 at block 602 and the 12 at block 606 are established to provide reasonable error detection with a low false alarm rate. If yes at block 606, then at block 608 a check is made to see if the key switch 544 shown in FIG. 5 is closed by the operator to indicate this is a head end car in control of the train; if not, the test injection operation is provided, and if yes, then at block 610 the control function is initialized by setting the fixed highest level variable equal to zero. At block 612, a check is made to see if the input fixed A frequency signal level is higher than the fixed highest level, which is now zero since it was just set to zero, so the answer is yes. At block 614 the input A signal level is stored as the fixed highest level. At block 616, the A fixed filter is stored as the fixed highest filter.

The purpose of blocks 612, 614 and 616 is to establish if the fixed filter now looked at is greater in signal level than the fixed filters previously looked at, and if so, it is identified as the highest signal level fixed filter. Since A is the first filter looked at, it is at first set at block 614 as the fixed highest filter. This same operation is then repeated for each of the B, C and F fixed filters, such that the one with the highest signal level is eventually set as the fixed highest filter.

At block 618 a check is made to see if the input fixed A signal level is greater than a predetermined threshold signal level, and if yes, at block 620 the variable fixed A data is set equal to one, and if not, at block 622 the variable fixed A data is set equal to zero. This indicates a data bit was or was not received. The threshold reference is a voltage level corresponding to about 30 milliamps in the track rail as related through the gains of the system as to how the currents in the rail translate into sensed voltage signals.

The same sequential operations of blocks 612, 614, 616, 618, 620 and 622 are now repeated for each of the B, C and F filters.

At block 624 a check is made to see if the input fixed B frequency signal level is higher than the fixed highest level, which was previously the input A signal level. If yes, then at block 626 the input B signal level is stored as the fixed highest level, and at block 628 the B fixed filter is stored as the fixed highest filter. If no at block 624, then the input A signal level remains as the fixed highest level. At block 630 the fixed B level is checked to see if it is greater than the threshold signal level, and if not at block 632 the variable fixed B data is set equal to zero, and if so at block 634 the variable fixed B data is set equal to one. At block 636 a check is made to see if the input fixed C frequency signal level is greater than the variable fixed highest level, which is now one of the A or B input signal level. If not, then B remains as the fixed highest level, and at block 638 a check is made to see if the fixed B level is greater than threshold. If not, at block 640 the fixed B data is set equal to zero, and if yes at block 642 the fixed B data is set equal to one.

At block 644 the input fixed F signal level is checked to see if it is greater than the present fixed highest level. If the answer is yes, at block 646 the F signal level is stored as the variable fixed highest level. At block 648 the fixed filter F is stored as the determined fixed highest filter. At block 650 a check is made to see if the fixed F level is greater than the provided threshold. If yes, at block 652 the fixed F data is set equal to one, and if not at block 654 the fixed F data is set equal to zero.

The above four signal level determinations for the respective A, B, C and F frequency filters establishes whether a data bit was received or not and the comparisons of the received bits to determine which has the highest amplitude level. It is possible that more than one such data bits are received, particularly when the train travels between adjacent track circuits. The present operation permits differentiating between more than one received data bit in relation to the subsequent speed decoding operation. Also, it is now known which of the four speed command signal frequencies has the highest signal level.

At block 656 a check is made to see if the hunter filter signal level is greater than the provided threshold. If yes, at block 658 the hunter data is set equal to one, and if not at block 660 the hunter data is set equal to zero. At block 662 a check is made to see if the present fixed highest level, which is assumed for this example to be the F signal level, is greater than the threshold. This is checking to see if none of the four fixed filter signals was above threshold, such that there is not reason to reconfigure the hunter filter frequency. If one of those fixed filter signals was highest and above threshold, then it is desired to change the hunter frequency to correspond with that one frequency. If yes at block 662, then at block 664 the hunter frequency select is set equal to the fixed highest filter, and if the answer is now at block 662, the block 664 is bypassed. An output of the hunter frequency select is made at block 666 to prepare for the next pass. This refreshes the output for the no answer at block 662 and updates the output for the yes answer at block 662. The program exits.

At block 608, if the key switch is not on, then this car is not a head end car and is not required to perform motion control for the train. This provides an opportunity to inject test data through the fixed filters for the purpose of establishing that there has been no operational gain change in any of those filters. The wayside provided signals are not as reliable for this purpose, since the wayside signal adjacent to a track shunt can be somewhat erratic and it is even possible for the wayside signals to momentarily disappear. At block 670 a check is made to see if the fixed filter signal level corresponding to the hunger frequency select as now set up is approximately equal to the test signal reference level. The test reference level is a known level provided by the crystal oscillator providing a reference level for the hunter filter. This establishes that the known-in-advance reference signal level from the hunter filter as a test signal after passing back through the corresponding frequency fixed filter should form a predictable fixed filter signal level coming into the microprocessor. If not, a safety error is indicated. If yes, at block 672 a similar check is made in relation to all other fixed filter signal levels using the same hunter filter crystal oscillator for this purpose to make sure all of the latter are zero, since there is not a corresponding frequency relationship for these other fixed filters. Only the one fixed filter having the same one or zero relationship and the same frequency relationship with the hunter frequency select should pass this signal. This requires sixteen passes for each of the eight frequencies and for the one and zero relationship, so only one fixed filter should pass the one frequency selected for the hunter. At block 674 a check is made to see if the hunter signal level is approximately equal to the test reference level. The answer should be yes or a safety error termination is made. At block 676 the hunter frequency select is set to the next test frequency, since this test operation injects each of the A1, A0, B1, B0, C1 C0, F1 and F0 signal frequencies for this injection test operation. In addition at block 676 the fixed filters have to be changed between ONES frequency select and ZEROS frequency select for each of the four frequency pairs in relation to the test signal injection operation to establish that the gain of each fixed filter operation is proper and satisfactory, with sixteen cycles being required through blocks 670, 672, 674 and 676 for this purpose. There are eight test signal frequencies that are repeated, and after every repetition of these eight frequencies the ONES and ZEROS switch is made.

The test injection operation is set up by selecting the hunter frequency, since the test reference injection signal is the hunter signal generated by the local channel hunter filter 522. In FIG. 5A, the key switch 544 when not closed by the operator, positions the switch 548 as shown such that the test signal 542 is then supplied to the local and remote microprocessor channels for this test purpose. The exclusive OR 549 modulates the test carrier 542 with a 9 Hz signal 543 to provide desired phase reversals. If the key switch 544 is closed, the relay 548 passes the track signal 566 to the local and remote microprocessor channels.

At block 606 if the reference level test fails or if any of the injection tests at blocks 670, 672 and 674 fails, then at block 678 a safety error termination is made. If a safety error is detected, all control outputs are inhibited to stop the train. The operator is told what the safety error is, and a power off and power back on is required by the operator. If the gain increase failure is in local microprocessor channel 306, the diagnostic operation will indicate to the operator that the channel 306 should be turned off for subsequent subsequent repair at the next opportunity, and the local microprocessor channel 320 is turned on for operation with the remote channel 308 to control motion of the train.

Figure 7A:
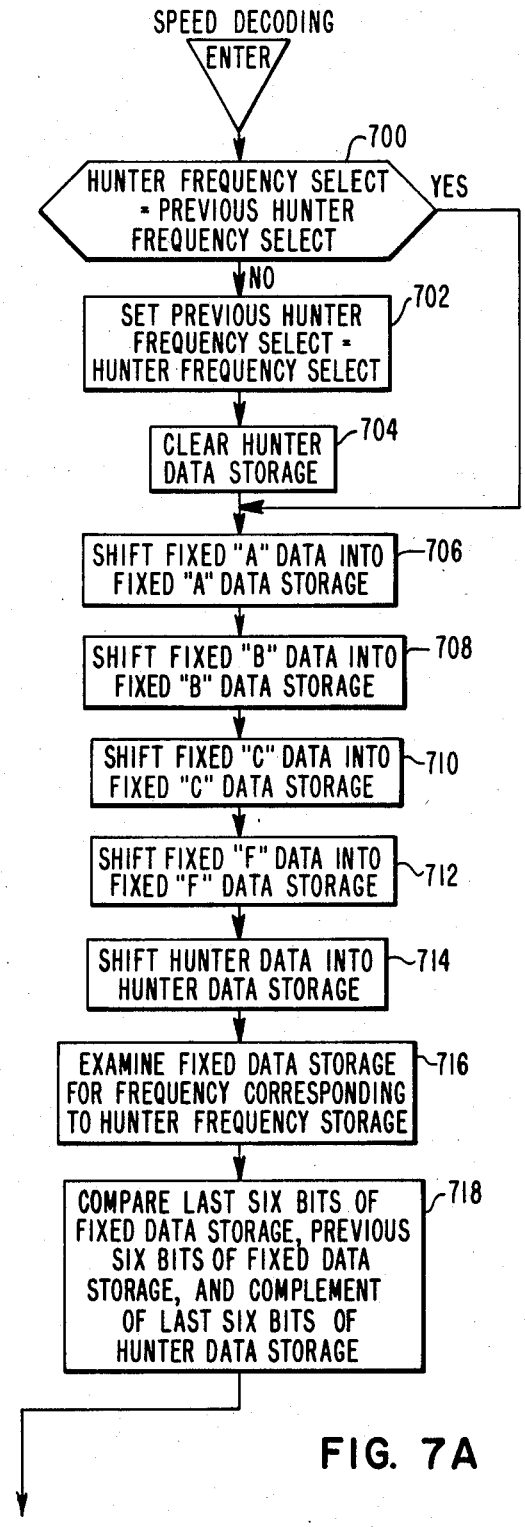
FIGS. 7A and 7B shows a flow chart to illustrate the speed decoding software operation of the present invention.
Figure 7B:
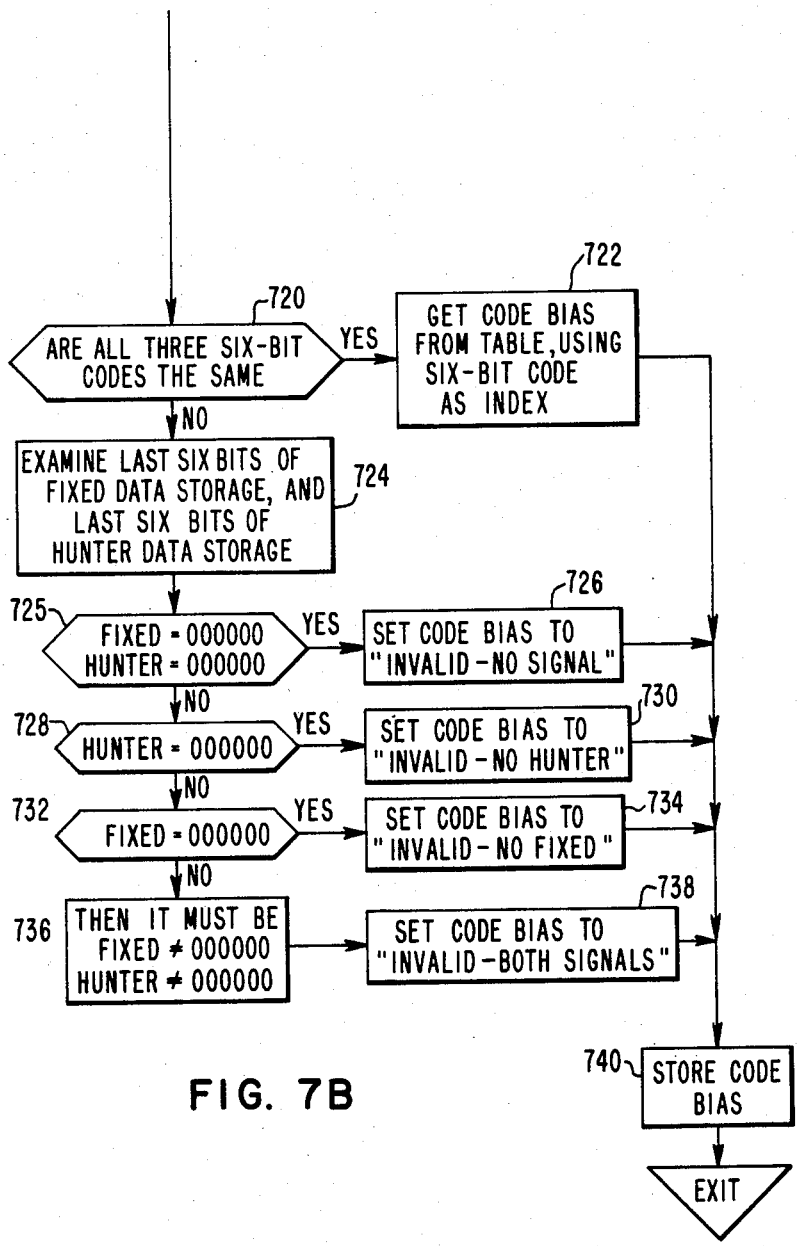

In FIGS. 7A and 7B, the speed decoding software flow chart is shown. The speed decoding operation obtains all required data information from the threshold assurance operation shown in FIG. 6. At block 700 a check is made to see if the hunter frequency select is the same as the previous pass through the routine, since if the hunter frequency changes, this means a new input speed command and the data previously stored is no longer meaningful. The hunter frequency select is changed only upon a new input signal having a fixed highest A, B, C or F signal level. If not, at block 702 the hunter frequency select is updated to the present hunter frequency select. At block 704 the previous hunter data storage is cleared.

At block 706 any fixed A data bit for this pass is shifted into fixed A data storage. At block 708 the same is done for any fixed B data bit, at block 710 the same is done for any fixed C data bit and at block 712 the same is done for any fixed F data bit. At block 714 the hunter data bit is shifted into the hunter data storage. The data storage at blocks 706, 708, 710, 712 and 714 is multibit storage so several passes through this program are required to establish the at least desired twelve bits for each of the four fixed filters and the at least six bits desired for the hunter filter. At block 716 the fixed data storage for the frequency corresponding to the hunter frequency is selected because the hunter is pointing to the strongest frequency. At block 718 a comparison is made of the last six bits of the selected fixed data storage, the previous six bits of the selected fixed data storage and the logical complement of the last six bits of the hunter data storage. At block 720 a check is made to see if all of those three six bit codes are the same. If yes, at block 722 the corresponding speed code bias is established in accordance with the following TABLE TWO using the six bit code as an index:

TABLE TWO

| Bias | Speed (mph) | Command (kph) | Sequence |
|---|---|---|---|
| 15 | 80 | 128.7 | 101111 |
| 14 | 70 | 112.7 | 100111 |
| 13 | 50 | 80.5 | 101011 |
| 12 | 36 | 57.9 | 100011 |
| 11 | 27 | 43.5 | 100101 |
| 10 | 18 | 29.0 | 101001 |
| 9 | 6 | 9.7 | 100001 |
| 8 | 0 | 0.0 | 100000 |
| 7 | | | |
| 6 | | | |
| 5 | | | |
| 4 | | | |
| 3 | | | |
| 2 | 0 | 0.0 | no 1's received |
| 1 | 0 | 0.0 | no 0's received |
| 0 | 0 | 0.0 | any other combination of 1's and 0's |

Four of the unused biases of 3, 4, 5, 6, and 7 can be assigned as codes for blocks 726 730, 734, and 738.

A look-up table comprising a sixty-four entry look-up table, with each code signal being a numeric index to the table, establishes this speed code bias. If the six bit codes are not all the same at block 720, then an invalid code is indicated so at block 724 the last six bits of the fixed data storage and the last six bits of the hunter data storage are examined in an effort to diagnose what the trouble is. For example, the transmitter for a given signal block might have failed or a broken shunt condition is present. At block 724 a check is made to see if the fixed code is all zeros and the hunter code is all zeros, which would indicate that no input speed command is being received. If yes, at block 726 the digital code bias is set to indicate an invalid signal condition with no input signal. If both the fixed and hunter codes are not all zeros, at block 728 a check is made to see if only the hunter six bit code is all zeros, and if yes at block 730, the code bias is set to indicate an invalid signal condition with no hunter signal but there is a fixed filter signal. If no at block 728, at block 732 a check is made to see if the fixed filter code is all zeros, and if yes at block 734 the code bias is set to indicate an invalid signal condition with no fixed signal but there is a hunter filter signal. At block 736 both the fixed and hunter signals are present but there is an invalid signal condition, which sets the speed bias at block 738 to provide such an indication. Block 740 stores the determined code bias, which is then used to generate the speed command for the train and is also compared between channels for safety purposes as shown in FIG. 4.

At block 722 all three six bit codes could be the same but not a valid speed code is provided. For example, if the wayside is supplying a continuous code of all one bits or a mix of zeros and ones, that is not a valid speed command. Therefore, the code bias table differentiates between valid and invalid speed commands as well as the relative shift or alignment of a valid six-bit comma-free speed command code that is desired in relation to the transmission of information that is not safety related but must be synchronized with the alignment of the speed code.

A speed code in the current system is composed of a frequency pair. For example, 5184 Hz and 7776 Hz. compose one frequency pair. In any frequency pair, the lower frequency is designated the ONES frequency and the higher frequency is designated the ZEROS frequency. These two frequencies are then combined in a specific 6-bit pattern with only phase reversals between "bits" of different frequencies.

The resulting pattern corresponds to a particular speed limit: 100111 might represent 70 MPH for example. Typically, four frequency pairs consisting of eight unique frequencies are used on a specific system to allow for different track blocks.

The new solid-state filter receiver design employs four "fixed" frequency filters in each channel with each filter tuned to one frequency member of the four frequency pairs. For example, all four may be tuned to the ZEROS frequencies in one channel and to the ONES frequencies in the second channel. This is consistent with the past mechanical and crystal filter designs.

In addition, a fifth filter is added to each channel. It is called the "hunter" filter. The "hunter" filter is identical in design to the other filters but it is controlled by the microprocessor. The microprocessor sets it to the corollary frequency of the "fixed" filter with the greatest received signal strength. If the frequencies being received by the four "fixed" filters are the ZEROS frequencies, then the "hunter" will lock onto the ONES frequency of the pair whose ZEROS frequency has the highest amplitude.

The outputs from the "fixed" filter and "hunter" filter are converted from analog to digital signals, thresholded in software, and compared on a ZEROS or ONES to ZEROs transition in the first channel. When a valid speed code is detected, this information is exchanged with the second channel which is processing identical information. Operation is permitted if the speed codes agree.

The second channel's "fixed" and "hunter" filters may be configured in a manner opposite to the first channel. In the previous example, where the first channel received the ZEROS frequencies on the "fixed" filters and the ZEROS frequencies on the "hunter" filter. When these channel cross-compares are statistically analyzed to determine the probability of unsafe failure they yield a mean-time between-hazard in excess of ten million years. The analysis assumes that signals are available to exercise the equipment so that failures can be detected. When the vehicle is placed out of service, for example in an area where no track signals are present, an internal test frequency generator is used to automatically input calibrated signals to the system to verify that no concurrent compensating failures occur during extended absence of signal.

Performance is also improved in so-called "confusion zones." Confusion zones are areas of track where two or more valid speed code frequency pairs may be simultaneously present. Since information on all frequency pairs is continually available, the detected frequency pair with the highest amplitude can be used. Storage is maintained separately for the data received from all frequencies.

The corresponding speed code will be chosen by the computer software as the valid speed code if the "fixed" filter and "hunter" filters agree, and that speed code will be used by the system as a valid speed code if the two microprocessor channels agree. Thus, one speed code will always take precedence, even if two or more valid speed codes are present. This avoids confusion which could cause the vehicle to undesirably apply brakes.

The commutating capacitor band-pass filter is essentially a four-pole linear-phase type low-pass filter with banks of four capacitors used for switching. It is followed by a four-pole low-pass filter to smooth out the staircase pattern output inherent in switched capacitor circuits. The signal is fed into a detector which rectifies the signal to produce a direct current output.

Figure 8:
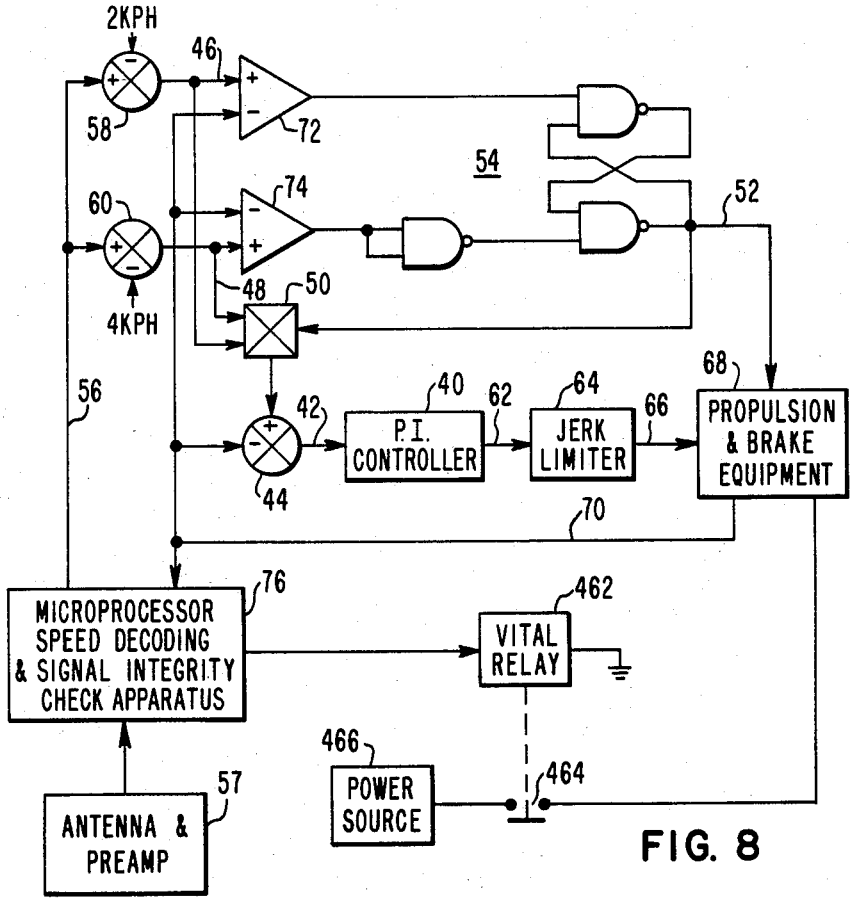
FIG. 8 shows the operation of the present speed decoding and signal integrity check apparatus with a vehicle speed maintaining apparatus.

In FIG. 8 there is functionally shown the present speed decoding and signal integrity and balance check apparatus applied to control a vehicle speed maintaining apparatus. The microprocessor speed decoding and signal integrity check apparatus 76 operates in accordance with the descriptions of FIGS. 6 and 7. The vital relay 462 is shown in FIG. 4 as is the contact 464 controlling the energization of the propulsion and brake equipment 68 by the power source 466.

Figure 9:
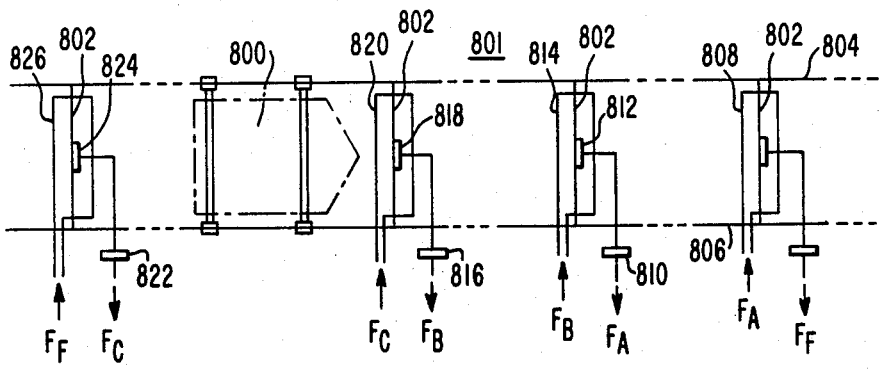
FIG. 9 shows a speed command signal block communication arrangement for the control of a transit vehicle.

In FIG. 9 there is shown a speed command signal block arrangement for the control of a vehicle in accordance with the present invention. The vehicle 800 travels along a track 801 including low impedance conductors 802 connected between the rails 804 and 806. A transmitting antenna 808 is energized with a speed command signal comprising the frequencies of frequency pair A, which signal is received by the receiver 810 operative with receiving antenna 812. The transmitting antenna 814 is energized with a speed command signal comprising the frequencies of frequency pair B, which signal is received by the receiver 816 operative with the receiving antenna 818. The transmitting antenna 820 is energized with a speed command signal comprising the frequencies of frequency pair C, which signal is received by the receiver 822 operative with the receiving antenna 824. The transmitting antenna 826 is energized with a speed command signal comprising the frequencies of frequency pair F. The track 801 can be divided into a plurality of signal blocks in this manner and energized as generally shown in FIG. 9. The track signal block arrangement is described in greater detail in U.S. Pat. No. 3,532,877 of G. M. Thorne-Booth.

What is claimed:

1. In apparatus for controlling a vehicle having a propulsion motor and moving along a track providing an input signal in accordance with a desired speed for said vehicle and comprising a plurality of frequency pairs having first and second information components, the combination of first means for determining the input signal frequency pair having the highest amplitude and including respective fixed frequency filters tuned in relation to one of the first and second information components of each frequency pair and a variable frequency filter tuned in relation to the other of the first and second information components of the highest amplitude frequency pair, and second means for comparing the highest amplitude frequency pair sensed by a fixed frequency filter and the frequency pair sensed by the variable frequency filter for determining said desired speed input signal for the vehicle.

2. The vehicle control apparatus of claim 1, with the input signal having a predetermined number of frequency pairs, said first means including a predetermined number of fixed frequency filters each tuned in relation to the first information component of a different one of said frequency pairs and with the variable frequency filter being tuned in relation to the second information component of the highest amplitude frequency pair.

3. The vehicle control apparatus of claim 1, with said first means including the fixed frequency filters determining the highest amplitude frequency pair by successively comparing the frequency pair amplitude of each fixed frequency filter.

4. The vehicle control apparatus of claim 1, including means providing a predetermined signal threshold for comparison with the highest amplitude frequency pair to establish that the highest amplitude frequency pair is a valid desired speed input signal.

5. The vehicle control apparatus of claim 1, including means coupled with the vehicle for sensing the actual speed of the vehicle, means comprising the actual speed with the desired speed for providing a speed error, and means operative with the propulsion motor for controlling the vehicle speed in response to the speed error.

6. The vehicle control apparatus of claim 1, with the input signal comprising a plurality of frequency pairs, with the first means determining the frequency pair having the highest amplitude, and with the variable frequency filter being capable of being tuned to each of said plurality of frequency pairs.

7. The vehicle control apparatus of claim 1 moving along a track including a plurality of signal blocks and having each signal block energized by a different input signal frequency pair, with the first means including a different fixed filter tuned to receive each frequency pair, and with the variable frequency filter being capable of being tuned to each frequency pair and being tuned to the highest amplitude input signal frequency pair determined by said first means.

8. The vehicle control apparatus of claim 1, including means for coupling the determined desired speed input signal with the propulsion motor to control the speed of said vehicle, means providing a test signal for determining the satisfactory operation of each fixed frequency filter in response to the operation of said desired speed input signal coupling means.

9. The vehicle control apparatus of claim 8, with said test signal comprising an output signal from the variable frequency filter.

10. The method of controlling a vehicle having a propulsion motor and moving along a track providing an input signal in accordance with a desired speed and having a plurality of frequency pairs each comprising first and second complementary information components, including the steps of:

determining the frequency pair having the highest signal amplitude, sensing a first information component of each frequency pair by operation of a different fixed frequency filter tuned to each first information component frequency of said input signal, sensing a second information component of the frequency pair having the highest signal amplitude by operation of a variable frequency filter tuned to the frequency of said second information component, establishing the desired speed for the vehicle in relation to the sensed first information component of the input signal having the highest signal amplitude and the sensed second information component of the latter input signal, sensing the actual speed of the vehicle, comparing the actual speed and the established desired speed for controlling the vehicle speed.

* * * * *